US005242166A

United States Patent [19]

Wong

[11] Patent Number: 5,242,166

[45] Date of Patent: Sep. 7, 1993

[54] DEVICE FOR INTELLECTUAL EXERCISE

[76] Inventor: Kah F. Wong, 12, Jalan 16, Desa Jaya, 52100 Kuala Lumpur, Malaysia

[21] Appl. No.: 903,123

[22] Filed: Jun. 23, 1992

[51] Int. Cl.[5] ..... A63F 9/08

[52] U.S. Cl. ..... 273/153 S; 446/489

[58] Field of Search ..... 273/153 S; 446/489 X; 434/175

[56] References Cited

U.S. PATENT DOCUMENTS

| | | | |
|---|---|---|---|
| 3,424,455 | 1/1969 | Dunson . | |
| 3,428,324 | 2/1969 | Weisbecker . | |
| 3,608,902 | 9/1971 | Weisbecker | 273/153 RX |
| 3,650,532 | 3/1972 | Dederich et al. | 273/1 R |
| 3,655,201 | 4/1972 | Nichols | 273/153 R X |
| 3,666,269 | 5/1972 | Glichrist | 273/115 |
| 3,692,311 | 9/1972 | Redo | 273/153 R |
| 3,924,857 | 12/1975 | Christensen | 273/153 R |
| 4,005,869 | 2/1977 | Maldonado | 273/158 |
| 4,015,852 | 4/1977 | Gibson | 273/153 R |
| 4,018,445 | 4/1977 | Anania, Sr. | 273/135 B |
| 4,065,132 | 12/1977 | Giakas | 273/153 R |
| 4,180,268 | 12/1979 | Brooks | 273/153 R |
| 4,216,964 | 8/1980 | Gans | 273/153 R |
| 4,379,555 | 4/1983 | Dean | 273/236 |
| 4,398,719 | 8/1983 | Nishimiya et al. | 273/153 R X |
| 4,403,776 | 9/1983 | Subotics et al. | 273/153 R |
| 4,407,504 | 10/1983 | Popov | 273/153 R |
| 4,452,454 | 6/1984 | Greene | 273/158 S |
| 4,522,401 | 6/1985 | Gustafson | 273/158 S |
| 4,548,411 | 10/1985 | Seidman | 273/153 R |
| 4,550,040 | 10/1985 | Fisher | 273/153 X |
| 4,570,935 | 2/1986 | Stefanini | 273/153 R |
| 4,575,087 | 3/1986 | Sinclair | 273/153 R |
| 4,667,960 | 5/1987 | Stefanini | 273/153 R |
| 4,674,749 | 6/1987 | Shaffer et al. | 273/153 R |
| 4,685,679 | 8/1987 | Ben-Gal et al. | 273/153 R |
| 4,687,201 | 8/1987 | Riviera | 273/153 R |
| 4,743,023 | 5/1988 | Collier | 273/113 |
| 4,746,123 | 5/1988 | Skirvin | 273/153 R |
| 4,752,074 | 6/1988 | Juang | 273/153 R |
| 4,763,899 | 8/1988 | Hundley | 273/26 B |
| 4,822,047 | 4/1989 | Treer | 273/113 |
| 4,872,682 | 10/1989 | Kuchimanchi et al. | 273/158 S |
| 4,877,406 | 10/1989 | Wilk | 273/158 S X |
| 4,949,969 | 8/1990 | Johnson | 273/153 R X |
| 4,989,872 | 2/1991 | Urrestarazu Borda | 273/139 |
| 4,993,715 | 2/1991 | Brooking | 273/158 S |
| 5,054,427 | 10/1991 | Hoover | 119/29 |
| 5,056,789 | 10/1991 | Talbot | 273/153 R |
| 5,096,198 | 3/1992 | Cook | 273/153 R |
| 5,114,148 | 5/1992 | Liu | 273/158 S |

*Primary Examiner*—Gene Mancene
*Assistant Examiner*—L. Thomas
*Attorney, Agent, or Firm*—Birch, Stewart, Kolasch & Birch

[57] ABSTRACT

A device for playing intellectual games includes a spherical body with predetermined inter-connecting grooves, wherein slidable pins are afixed. The exposed surface of the slidable pins are coded to carry any desired visual representations.

11 Claims, 4 Drawing Sheets

DEVICE FOR INTELLECTUAL EXERCISE

BACKGROUND OF THE INVENTION

1. Field of the Invention

This invention relates to a device for intellectual exercises and in particular to a spherical device with a plurality of grooves laid out in a predetermined manner to accommodate slidable pinheads. The grooves are laid out in a predetermined manner and are dimensioned in a manner to control the sliding movement of pinheads from one part of the spherical device to another part.

2. Description of Related Art

Devices for games wherein the parts of the surfaces are movable from one position to another position are generally cuboidal in shape. The parts of the surface that are moveable are generally square in shape.

SUMMARY OF THE INVENTION

It is an object of the present invention to provide a substantially spherical device wherein pinheads can be slidably positioned to achieve any desired surface configuration of pin heads.

According to the invention there is provided a device for playing intellectual exercises wherein the device is substantially spherical in shape and comprises of a plurality of inter-connecting grooves laid out in a desired pattern and a plurality of pins slidable along the inter-connecting grooves. In a preferred embodiment the device is spherical in shape. The device includes a two Y-shaped inter-connecting grooves, one at the diametrically opposite sides of the sphere. Between these two Y-shaped grooves, are a plurality of X-shaped grooves. A plurality of slidable pins are introduced into the grooves. The exposed external surface of the pin is coded to carry any desired visual demarcations. The islets formed by the inter-connecting grooves are secured to a core body within the spherical device. In another aspect, the device includes a web of inter-connecting grooves substantially all over the surface with at least one partially free surface area with at least one groove traversing the said free surface area and connecting the web of inter-connecting grooves. As before, a plurality of slidable pins are introduced into the grooves.

BRIEF DESCRIPTION OF THE DRAWINGS

In order that the invention may be come clearly understood reference will now be made to the accompanying drawings which illustrate a preferred embodiment of the invention.

DETAILED DESCRIPTION OF PREFERRED EMBODIMENTS

Figure 1:
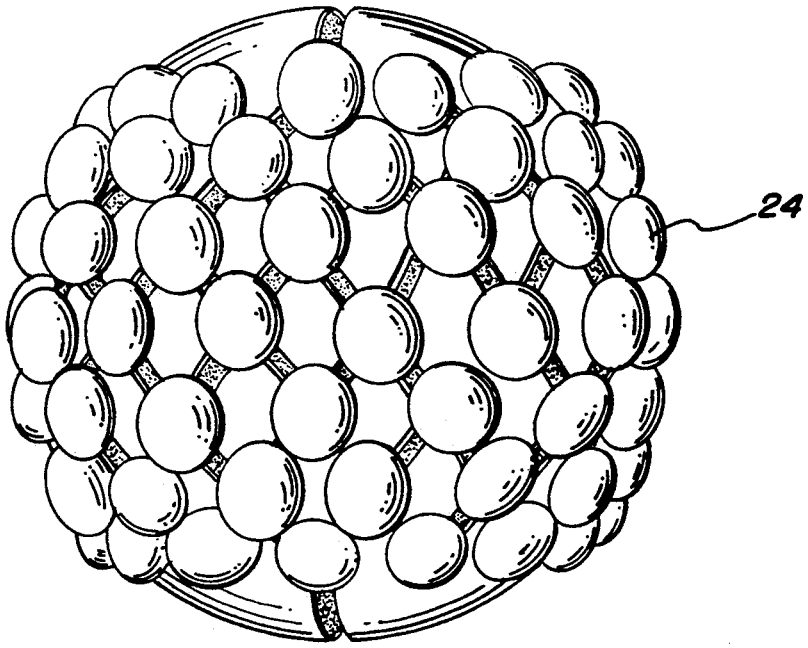
FIG. 1 illustrates a spherical device with pin heads all assembled.
Figure 2:
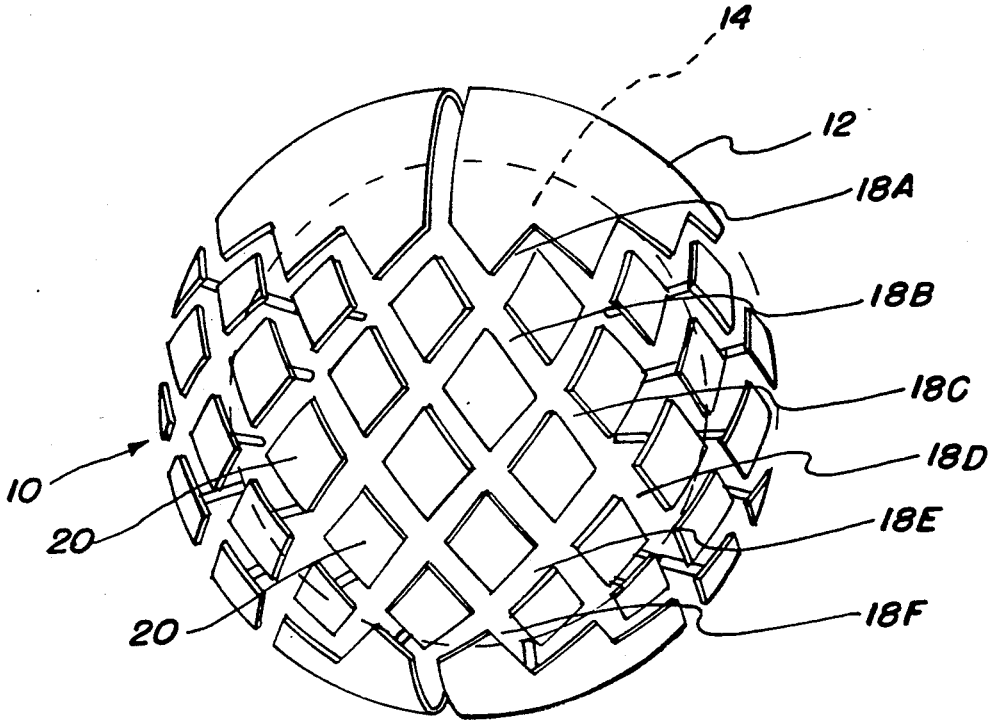
FIG. 2 illustrates a side of the spherical device of FIG. 1, but with the pin-heads removed to show the grooves clearly.
Figure 3A:
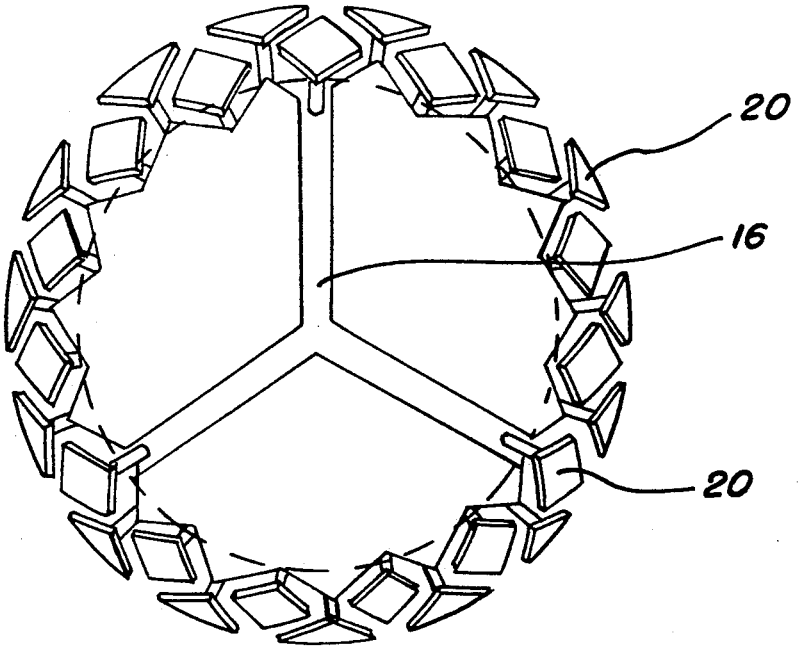
FIG. 3A illustrates a top view of the spherical device of FIG. 2 (the bottom view corresponds)
Figure 3B:
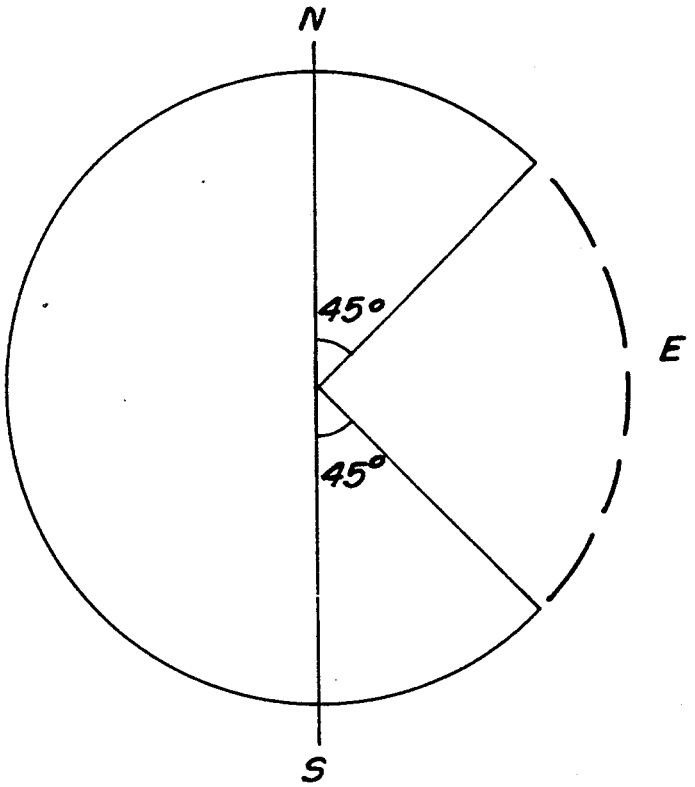
FIG. 3B is a diagrammatic representation of a vertical section of the spherical device.
Figure 4:
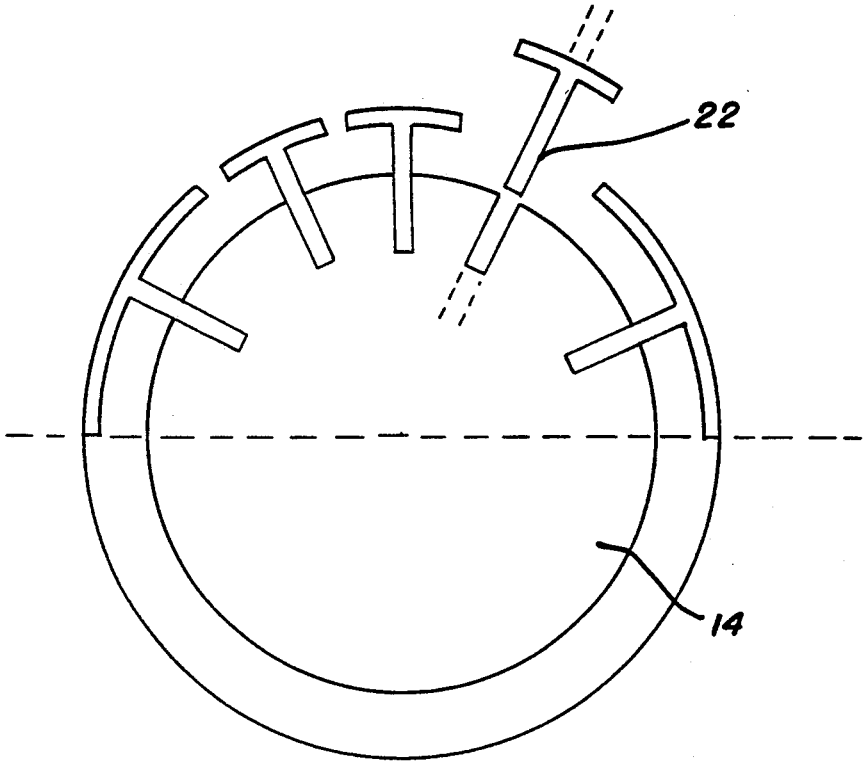
FIG. 4 illustrates a diagrammatic sectional view of the spherical device but with pinheads removed.
Figure 5A:
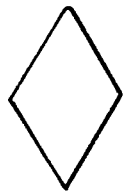
FIG. 5 illustrates a plan A, side B and perspective view C of a section of the spherical device, which is affixed to a core receipiant body.
Figure 5B:
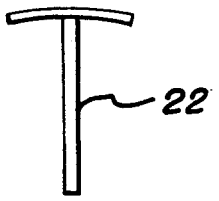
Figure 5C:
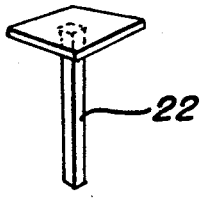
Figure 6A:
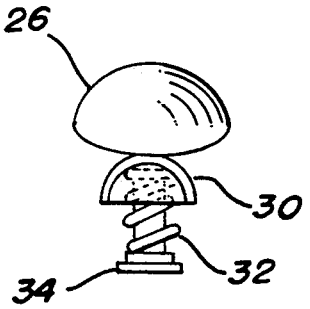
FIG. 6A illustrates a complete assembled pinhead.
Figure 6B:
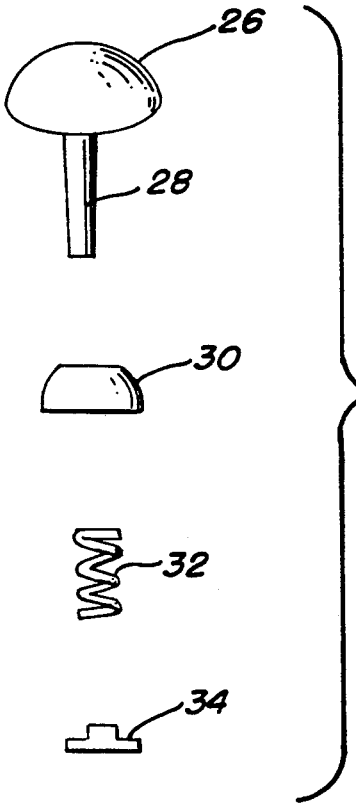
FIG. 6B illustrates a side view of the components of a pin-head in assembly sequence.

Referring to FIGS. 2 and 3A, there is shown a spherical device 10 with an outer shell structure 12 and an internal core body 14. For the sole purpose of describing the invention, the spherical device is zoned in the conventional manner of geographical zoning of the globe. At the north and south poles of the spherical device, are provided a Y-shaped groove where the arms and the legs of the groove are spaced equisdistantly apart (see FIG. 3A). The grooves 16 extend substantially 45° down the vertical North-South Axis (see FIG. 3B). In another aspect, the grooves can extend at an acute angle down the vertical North-South axis. In other embodiments, the North pole or South pole region or both the North and South pole region can be a partially free surface area with only one transverse groove connecting the web of inter-connecting grooves.

Between the triangular sections formed by the grooves at the North and South Poles, are six zig-zag grooves 18A–F linked together, and encircling the spherical device 12. Each angle of bend in the zig-zig groove is equal in size. From the diagram, it is apparent that the linking of the grooves in the manner stated results in free standing islets 20. The islets are of uniform size and shape throughout the spherical device. In one aspect, it will be seen there are a series of parallel columns, of five rhombus shaped islets between the upper and lower triangular sections.

The area bounded by immediately adjacent zig-zag grooves include fifteen islets. Thus the spherical device includes at least 45 islets arranged in a pre-determined sequence as described above. Other numerical number of islets can be adopted, depending on the desired complexity and/or design of the intellectual game. The triangular sections and the islets forming the sphere are spatially configured in position by suitable means. In the embodiment described herein, the triangular sections and the islets are secured to a core body by pins 22. Alternatively the triangular sections and the islets can be inter-connected by suitable connecting means beneath the sections and islets and spatially separated from the grooves.

It will be understood that the spherical device including the core body and the islets when assembled are substantially a smooth spherical body with each islet lying along the same spherical planar surface.

The invention further includes a plurality of slidable pins 24. The pins 24 are accommodated in the grooves and are slidable along the grooves. Each pin 24 consists of a head portion 26, and a shaft portion 28 attached to the underside of the head. The pin 24 further includes a biasing surface 30 and a biasing means 32. Advantageously the pin may also include a restraining member 34 to secure the biasing means 32 and the biasing surface 30 in position. To facilitate ease of sliding movement, the underside of the pin head is convex in shape and upper surface of the biasing surface 30 is convex in shape. The biasing means is a preferably a helical spring.

Alternatively the slidable pin can include a head portion 26 with a shaft portion to a tight fitting resilient lower grip portion. To facilitate the sliding movement of the pin, the lower grip portion can be hemispherical or convex in shape. The distance between the lower surface of the pin head and the uppermost surface of the lower grip portion are dimensioned in a manner to provide a good but slidable grip on the grooves.

The slidable pins 24 are introduced into the grooves and are slidable along all the grooves including Y-shaped grooves at the North and South poles of the sphere of the transverse grooves in the alternate embodiment of the invention.

I claim:

1. A spherical manipulative device comprising:

an internal spherical core member;

a plurality of discrete islet members spaced apart from and formed in a band arrangement around an equator of said internal spherical core member;

a plurality of discrete outer shell members spaced apart from said internal spherical core member and positioned above and below the band of islet members, each of said discrete outer shell members having a larger surface area than each of said discrete islet members;

means for connecting each of said plurality of discrete islets to said internal spherical core member;

means for connecting each of said discrete outer shell members to said internal spherical core member;

a plurality of interconnecting grooves defined by a spacing between adjacent ones of said plurality of discrete islet members and said plurality of discrete outer shell members; and a plurality of individually movable pieces slidable within said plurality of interconnecting grooves.

2. The device according to claim 1, wherein said plurality of discrete islet members are co-spherical with said plurality of discrete outer shell members.

3. The device according to claim 1, wherein said means for connecting each of said plurality of discrete islet members to said internal spherical core member includes a pin fixed to both said core and said islet.

4. The device according to claim 1, wherein said means for connecting each of said plurality of discrete outer shell members to said internal spherical core member includes at least one pin fixed to both said core and said shell member.

5. The device according to claim 1, wherein each of said plurality of individually movable pieces includes a head portion, a shaft fixed to said head portion, a biasing surface axially slidable on said shaft, a restraining member fixed to an opposing end of the shaft from the head portion, and a biasing spring axially positioned on the shaft between the biasing surface and the restraining member.

6. The device according to claim 5, wherein the head portion and the restraining member are of a greater diameter than a width of said plurality of interconnecting grooves such that the head portion rests on adjacent ones of said plurality of discrete islets and adjacent ones of said plurality of outer shell members.

7. The device according to claim 6, wherein a lifting of the head portion away from said plurality of interconnecting grooves is limited by the restraining member to prevent said movable pieces from being removed from said device and wherein said movable pieces are slidable along said plurality of interconnected grooves.

8. The device according to claim 1, wherein said plurality of interconnecting grooves include at least one transverse groove at least at one pole thereof and a plurality of polygonal shaped grooves defining a shape of each of said plurality of discrete islets, all linked together to form a continuous groove.

9. The device according to claim 8, wherein the at least one transverse groove is Y-shaped.

10. The device according to claim 1, wherein said plurality of discrete islets include at least one of a three, four, five, and six-sided shape.

11. The device according to claim 1, wherein there are at least 45 of said plurality of discrete islets.

* * * * *